United States Patent [19]

Caldwell

[11] Patent Number: 4,765,123

[45] Date of Patent: Aug. 23, 1988

[54] PROCESS FOR COVERING PAINT TRAYS

[76] Inventor: Nancy E. Caldwell, 6037 S. Painter, Whittier, Calif. 90601

[21] Appl. No.: 116,674

[22] Filed: Nov. 4, 1987

[51] Int. Cl.[4] ..... B65B 3/00; B65B 67/12

[52] U.S. Cl. ..... 53/459; 53/469; 53/464; 414/403

[58] Field of Search ..... 53/459, 468, 449, 469, 53/464, 473, 174, 175, 390; 414/288, 403, 405

[56] References Cited

U.S. PATENT DOCUMENTS

| | | | |
|---|---|---|---|
| 2,296,664 | 9/1942 | Hall | 53/174 X |
| 2,555,584 | 6/1951 | Fairbank | 53/469 X |
| 2,939,259 | 6/1960 | Heckler | 53/464 X |
| 2,989,828 | 6/1961 | Warp | 53/390 |
| 3,082,096 | 3/1963 | Powers | 53/469 X |
| 3,448,913 | 6/1969 | Wolff | 53/390 X |
| 3,822,524 | 7/1974 | Jerpbak | 53/469 X |
| 4,014,157 | 3/1977 | Pearce | 53/459 |
| 4,037,778 | 7/1977 | Boyle | 53/390 X |
| 4,254,602 | 3/1981 | Boynton | 53/390 |

*Primary Examiner*—Horace M. Culver

*Attorney, Agent, or Firm*—Edgar W. Averill, Jr.

[57] ABSTRACT

A process for covering a paint tray so that it may be reused without the necessity of cleaning. The process involves the placing of a flexible, paint-impervious bag over the entire paint tray before any paint is placed therein. The bag is sufficiently large so that a portion of it fits against the interior of the tray and is of sufficient length so that it extends past the end of the paint tray. After the paint tray has been used, the plastic bag is completely reversed thereby capturing and containing all the paint that was formerly in the tray leaving a completely clean tray.

7 Claims, 1 Drawing Sheet

FIG. 1.
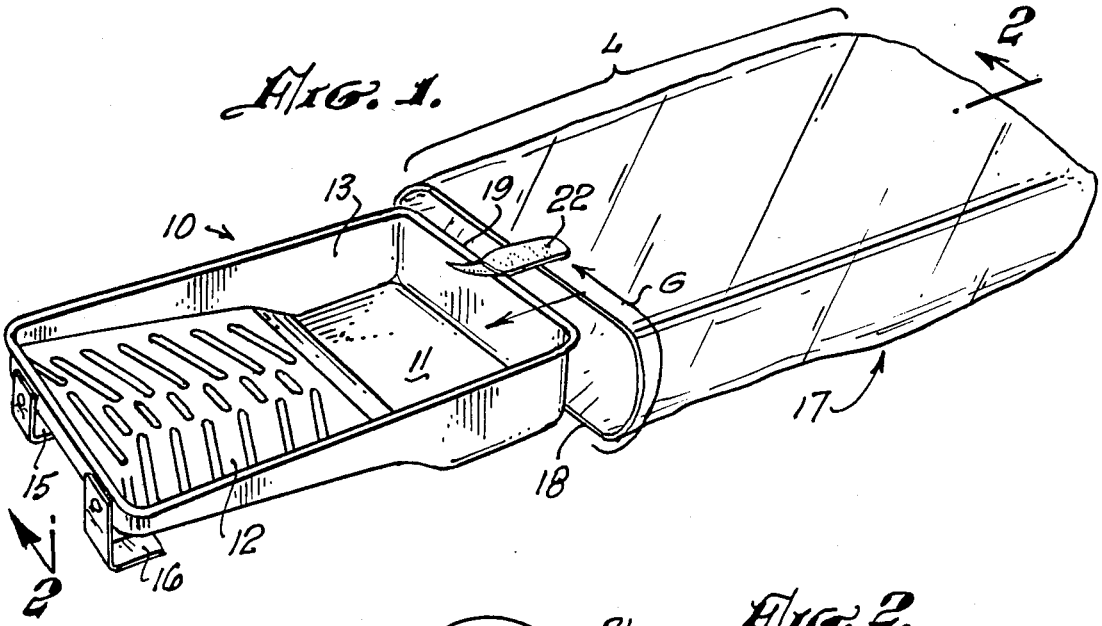
FIG. 2.
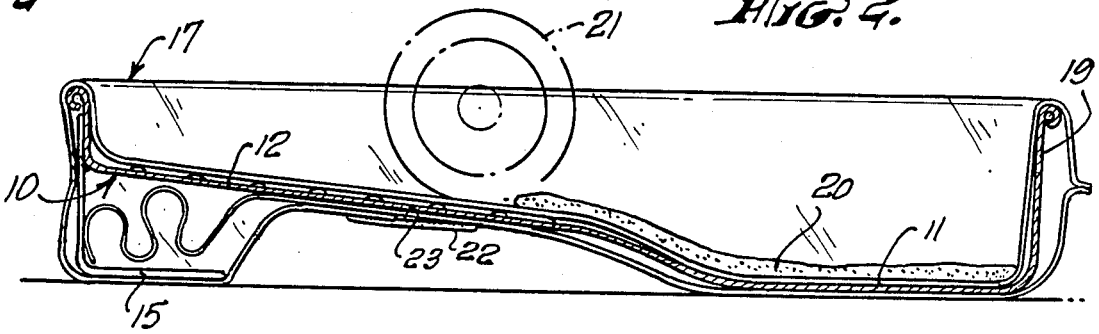
FIG. 3.
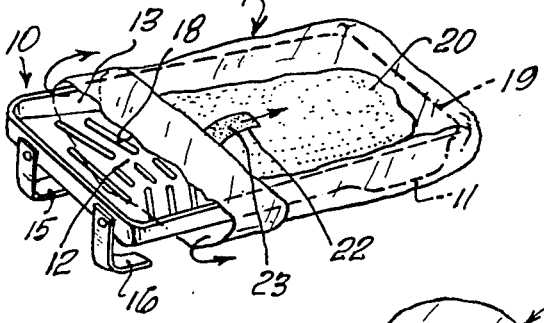
FIG. 4.
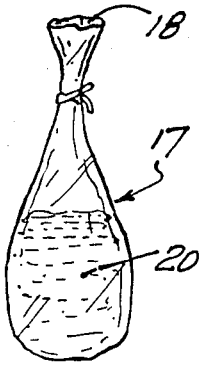
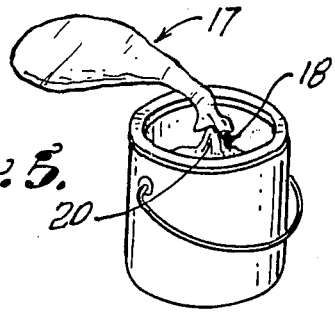
FIG. 5.

FIG. 1.
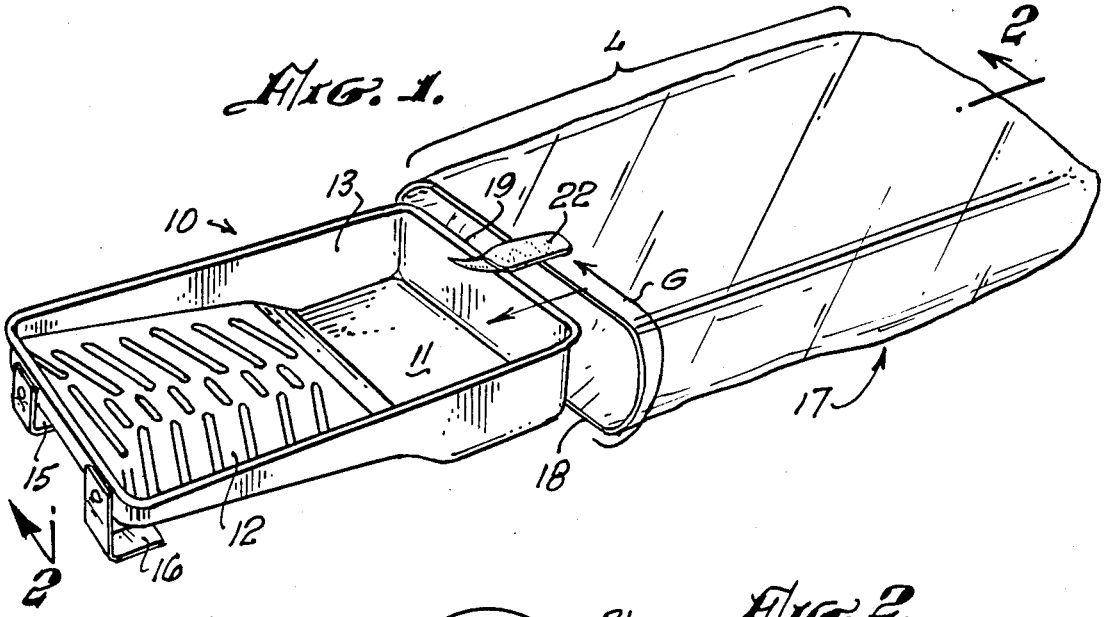
FIG. 2.
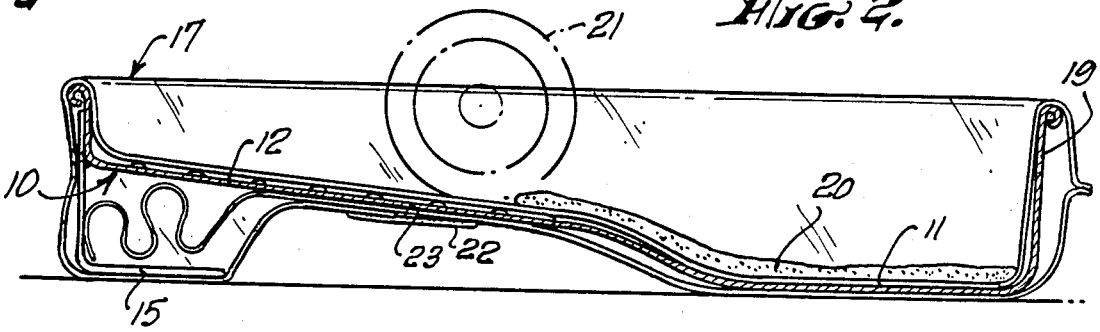
FIG. 3.
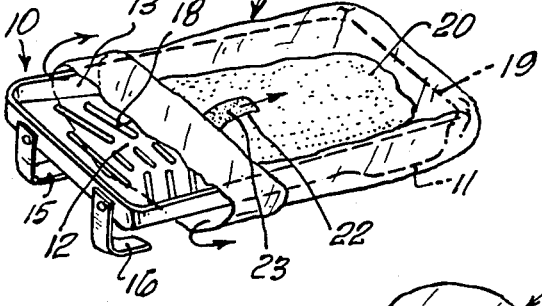
FIG. 4.
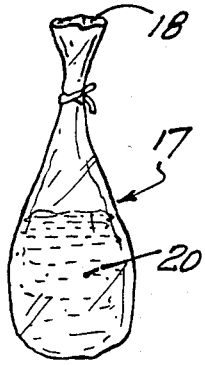
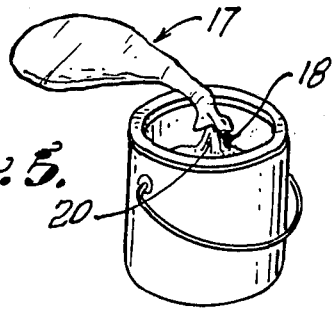
FIG. 5.

FIG. 1.
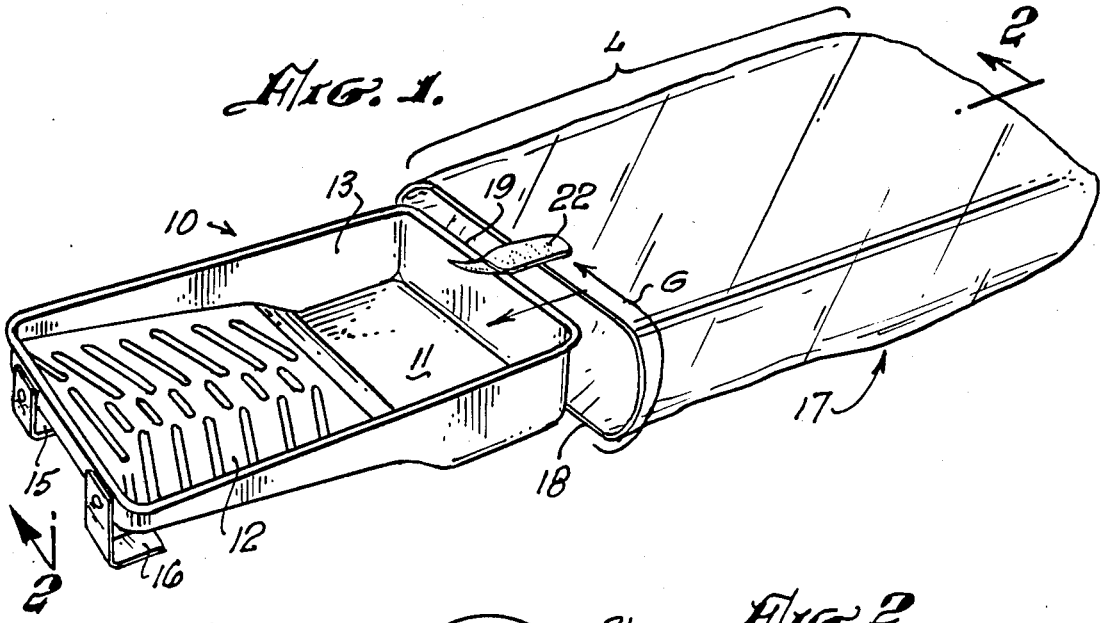
FIG. 2.
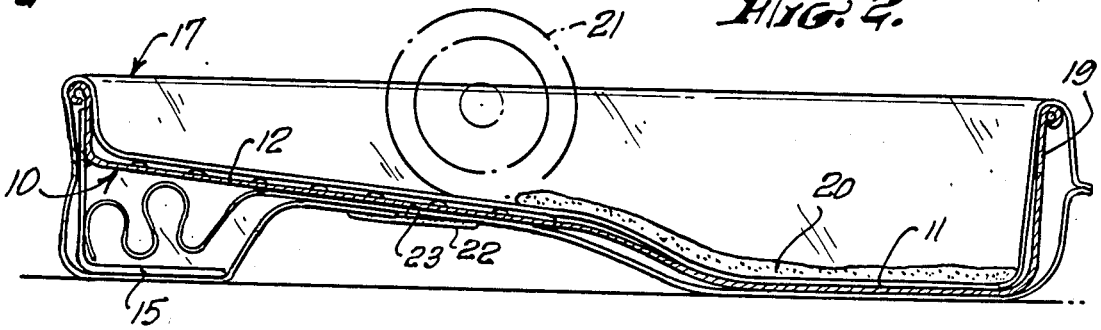
FIG. 3.
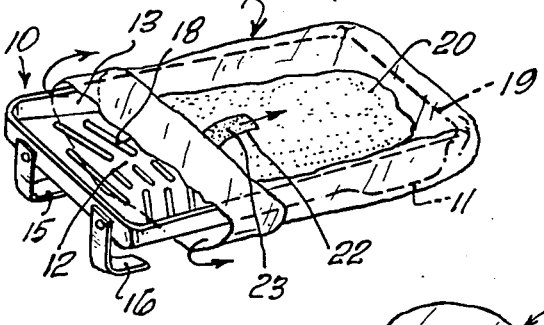
FIG. 4.
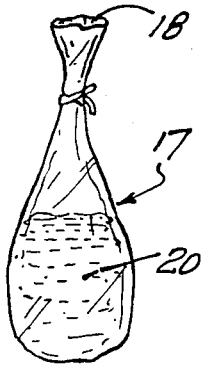
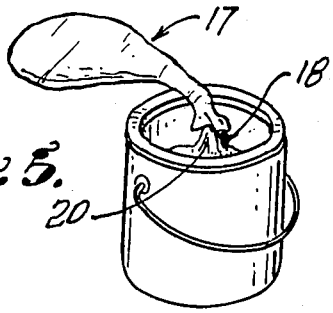
FIG. 5.

PROCESS FOR COVERING PAINT TRAYS

BACKGROUND OF THE INVENTION

The field of the invention is painting and the invention relates more particularly to painting by means of a roller which is loaded by the use of a paint tray.

Paint trays are commonly used without any liner at all and are typically cleaned by pouring excess paint into the original paint can and then brushing out excess paint followed by a wiping or solvent cleaning step. This process is not only time consuming but also leaves a small amount of paint which can contaminate and discolor later painting processes. A preferable process involves the use of a vacuum formed, thin, rigid plastic liner of the type generally shown in U.S. Pat. No. 3,157,902. Such liner is placed within the paint tray and closely conforms to the shape of the paint tray. When the painting job is finished, the excess paint within the liner is poured out of the liner into the original paint can and the liner discarded. The pouring out process is a slow one particularly for a relatively thick paint and the liner now becomes a potential source of paint spillage if not carefully discarded. Also, the liners can become cracked and take up storage space. A flexible, plastic liner is shown in U.S. Pat. No. 2,922,176 but this requires a specially designed paint tray and does not provide an efficient means of discarding or transferring excess paint.

SUMMARY OF THE INVENTION

It is an object of the present invention to provide an inexpensive and efficient way of lining a paint tray.

The present invention is for a process for covering a paint tray so that it may be reused without the necessity of cleaning formerly-used paint therefrom. The process comprises the steps of placing a flexible, paint-impervious bag over the entire paint tray before placing any paint therein. The flexible, paint-impervious bag is suffiriently large in girth so that it may fit against the interior of the tray and of sufficient length so it extends past the end of the paint tray when placed thereover. After the paint has been used, the flexible bag is completely reversed thereby containing any paint left within the paint tray in ths interior of the reversed bag thus leaving a completely clean tray. Preferably, the process includes the step of adhering a portion of the open end of the bag against the portion of the bag which is under the tray. The process may further include the step of pouring paint from within the revesrsed bag into a paint receptacle.

BRIEF DESCRIPTION OF THE DRAWINGS

FIG. 1 is a perspective view of a paint tray and a paint-impervious bag.

FIG. 2 is a cross-sectional side view of the paint tray of FIG. 1 with the bag of FIG. 1 placed thereover.

FIG. 3 is a perspective view showing the beginning of the process of reversing the bag after it has been used and as it is removed from the paint tray.

FIG. 4 is a side view showing the reversed bag containing the residual paint therein.

FIG. 5 shows the step of pouring the paint from the bag of FIG. 4 into a container.

DESCRIPTION OF THE PREFERRED EMBODIMENTS

A paint tray is shown in FIG. 1 and indicated generally by reference character 10. Paint tray 10 has an interior surface made up of a floor 11, a ribbed ramp 12 and a peripheral side 13. A pair of feet 15 and 16 are welded to the outer surface of side 13 at the shallow end. A flexible paint-impervious bag 17 has an opening 18 which has a girth sufficiently large to fit over the floor end 19 of tray 10. The girth is indicated by reference character "G" in FIG. 1. The girth is sufficiently large so that the bag, in addition to fitting over floor end 19, it also is large enough so that it lies down into the floor 11 and against the inner surface of the sides. The length of the bag, indicated by the letter "L" is longer than the distance between floor end 19 and ramp end 14 so that the opening of the bag will extend past the ramp end 14 when the bag is placed over the paint tray. Although the bag could be placed over the ramp end rather than the floor end, such process has several disadvantages. First, it increases the possibility that the bag could be punctured by foot 15 or 16. Secondly, the bunching up of the bag, as indicated in FIG. 2, would then be located under floor 11 which could provide a somewhat less flat surface making the tray slightly less stable.

The bag 17, having been placed over paint tray 10, is shown in cross-sectional side view in FIG. 2. There it can be seen that the bag is sutticiently large so that it may be moved downwardly against floor 11 and against the sides 13. A portion of paint 20 is shown held within tray 10 and. along the outer surface of bag 17. The paint tray may be then used in a conventional manner and a roller is shown in phantom view in FIG. 2 and indicated by reference character 21.

Preferably, the opening 18 of the bag includes a short length of delayed-tack adhesive tape 22 so that its adhesive surface 23 is in the direction shown in FIG. 1. This tape may then be used to secure a portion of opening 18 against the underside of the bag under ribbed ramp 12 as shown in FIG. 2 This secures the bag in place. It should be noted that even if one of the feet 15 or 16 should puncture bag 17, the location of the puncture would be very near the opening and would cause no problem whatsoever in the process of the present invention.

The process of removing the bag to leave a completely clean tray is depicted in FIG. 3 where tape 22 has been freed from the underside of the bag and the opening folded back over itself, thus containing paint 22 inside the bag as shown in FIG. 4. The excess paint then may be simply deposited in the trash without fear of spilling or the paint may be easily poured, as shown in FIG. 5, into a paint can 24. It should also be noted that rather than waiting for the paint to drain out, as is necessary with the prior art vacuum-formed tray, the user may readily squeeze the bag to quickly expel any paint therein. The empty bag is then discarded.

The flexible, paint-impervious bag of the present invention is preferably fabricated from an inexpensive polymer such as polyethylene. The bag should be thicker than the plastic sheeting typically used for most paint covering operations, and a thickness of between 1.5 and 3 mils, has been found to provide sufficient strength and ease of handling. A thickness of two (2) mils is preferred.

The process of the present invention utilizes a plastic bag which may be very inexpensively fabricated, is unbreakable and very easily stored. The result of the use of such bag not only protects the paint tray, but also facilitates the disposal or transfer of paint from within the reversed bag. The bag may be sealed with a tie 25, as shown in FIG. 4, and such ties are commonly used and inexpensive.

The present embodiments of this invention are thus to be considered in all respects as illustrative and not restrictive; the scope of the invention being indicated by the appended claims rather than by the foregoing description. All changes which come within the meaning and range of equivalency of the claims re intended to be embraced therein.

What is claimed is:

1. A process for covering a paint tray so that it may be reused without the necessity of cleaning formerly used paint therefrom, said process comprising:

placing a flexible, paint-impervious bag over the entire paint tray before placing any paint therein, said flexible, paint-impervious bag being sufficiently large in girth so that it may fit against the interior of the tray and of sufficient length so that it extends past the end of the paint tray when placed thereover;

after the paint tray has been used, completely reversing the flexible, paint-impervious bag thereby containing any paint left within said paint tray in the interior of the reversed paint-impervious bags, thus leaving a completely clean tray.

2. The process ot claim 1 further including the step of adhering a portion of the open end of the bag, which extends over the end of the paint tray, to a portion of the bag at the underside of the tray to hold the bag in place.

3. The process of claim 2 wherein the adhering step is performed with a length of delayed-tack tape.

4. The process of claim 1 further including the step of pouring paint from within the reversed bag into a paint receptacle.

5. The process of claim 1 wherein the bag is fabricated from polyethylene.

6. The process of claim 5 wherein the polyethylene has a thickness of between about 1.5 mils and 3 mils.

7. The process of claim 5 wherein the polyethylene has a thickness of between about 2 mils.

* * * * *